US007793712B2

(12) United States Patent
Yamate et al.

(10) Patent No.: US 7,793,712 B2
(45) Date of Patent: Sep. 14, 2010

(54) DOWNHOLE TOOL

(75) Inventors: Tsutomu Yamate, Yokohama (JP); Hiroshi Inoue, Yokohama (JP); Jiro Takeda, Machida (JP); Yukio Sudo, Machida (JP); Emmanuel Desroques, Tokyo (JP); Satoru Umemoto, Kawasaki (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 231 days.

(21) Appl. No.: 11/844,339

(22) Filed: Aug. 23, 2007

(65) Prior Publication Data

US 2008/0047751 A1 Feb. 28, 2008

Related U.S. Application Data

(60) Provisional application No. 60/823,383, filed on Aug. 24, 2006.

(51) Int. Cl.

| | |
|---|---|
| ***E21B 29/02*** | (2006.01) |
| ***E21B 47/00*** | (2006.01) |
| ***E21B 49/00*** | (2006.01) |
| ***E21B 47/12*** | (2006.01) |

(52) U.S. Cl. ..... 166/65.1; 166/254.2; 175/50; 73/152.01; 73/152.02

(58) Field of Classification Search ..... 166/65.1, 166/254.2; 73/152.01, 152.02, 152.13, 152.14, 73/152.18, 152.27

See application file for complete search history.

(56) References Cited

U.S. PATENT DOCUMENTS

| | | | | |
|---|---|---|---|---|
| 2,914,677 | A * | 11/1959 | Arnold | 376/118 |
| 3,672,215 | A * | 6/1972 | Stout et al. | 73/152.12 |
| 6,630,890 | B1 | 10/2003 | Endo et al. | |
| 7,334,465 | B2 * | 2/2008 | Smits et al. | 73/152.14 |
| 7,442,932 | B2 * | 10/2008 | Schultz et al. | 250/338.1 |
| 2007/0034793 | A1 * | 2/2007 | Estes et al. | 250/269.1 |

FOREIGN PATENT DOCUMENTS

WO 01/33704 A1 5/2001

OTHER PUBLICATIONS

O. Aktas, Z. F. Fan, S. N. Mohammad, A. E. Botchkarev, and H. Morkoc, "High temperature characteristics of AlGaN/GaN modulation doped field effect transistors", Applied Phys Lett, vol. 69, Issue 16, pp. 3872-3874, 1996.

T. P. Chow and R. Tyagi, "Wide bandgap compound semiconductors for superior high-voltage unipolar power devices", IEEE Trans. Electron Device, vol. 41, No. 8, pp. 1481-1483, 1994.

(Continued)

*Primary Examiner*—David J Bagnell
*Assistant Examiner*—James G Sayre
(74) *Attorney, Agent, or Firm*—Daryl Wright; Jody DeStefanis; Jeff Griffin

(57) ABSTRACT

A downhole tool, configured to be suspended in a borehole traversing an earth formation, includes a downhole data acquisition system placed in the tool body and electrically connected to an electric power generator at the formation surface. The downhole data acquisition system includes a sensor for detecting local conditions in the borehole, and a transducer for transducing the voltage of an input signal from high to low or low to high. The transducer having a gallium nitride or silicon carbide based discrete semiconductor device.

10 Claims, 9 Drawing Sheets

OTHER PUBLICATIONS

A. Ozgur, W. Kim, Z. Fan, A. Botchkarev, A. Salvador, S. N. Mohammad, and B. Sverdlov, "High transconductance normally-off GaN MODFETs", Electronics Letters, vol. 31, pp. 1389-1390, 1995.

S. Yoshida, J. Li, T. Wada, and H. Takehara, "High-Power AlGaN/GaN HFET with a Lower On-state Resistance and a Higher Switching Time for an Inverter Circuit", in Proc. 15th ISPSD, pp. 58-61, 2003.

* cited by examiner

DOWNHOLE TOOL

RELATED APPLICATIONS

This application claims priority to U.S. provisional application No. 60/823,383, filed Aug. 24, 2006, and entitled "High Temperature Power Devices," which is incorporated herein by reference in its entirety.

FIELD

The present invention relates to a downhole tool.

BACKGROUND

Data relating to earth formations are acquired by logging operations for purposes of oilfield exploration and development. Such operations, including wireline logging, measurement-while-drilling (MWD) and logging-while-drilling (LWD), typically use a downhole tool having various electronic components for collecting, storing, and transmitting data.

After drilling a well, various electronic devices may be fixed to a production tubing for purposes of analyzing hydrocarbons and other fluids present in the borehole or wellbore, and for control of fluid flows in the borehole. In this, various electronic devices typically are used for purposes of production logging.

Seismic data gathering and long term reservoir monitoring are other applications that require deployment of electronics in completed boreholes. Sensor arrays may be deployed in the borehole by various means and sensor data gathered and transmitted uphole by a telemetry system for processing and analysis. Robust and durable tool electronics are necessary for such operations.

Recent developments in drilling technology require that electronics such as the mentioned sensors should be capable of withstanding exposure to significantly higher pressures and temperatures that are encountered at increasing well depths. In this, conventional electronics degrade or fail in performance characteristics when exposed to temperatures approaching 200 degrees Celsius (° C.). Therefore, there is a need for improved electronic tool systems that are capable of operating effectively at temperatures in the range of 200 degrees Celsius and above.

SUMMARY

In consequence of the background discussed above, and other factors that are known in the field of oilfield exploration and development, some embodiments of downhole tools are disclosed herein comprising electronic devices that are suitable for high temperature applications over extended periods of time. Such electronic tool systems may be used for collecting and storing downhole data in high temperature, harsh downhole conditions.

According to one embodiment disclosed herein, a downhole tool, to be suspended in a borehole, includes a downhole data acquisition system, electrically connected to an electric power generator placed at the formation surface via a cable, to be supplied with the electric power generated by the electric power generator. The downhole data acquisition system includes a sensor for detecting a local condition in the borehole, and a transducer for transducing the voltage of an input signal from high to low or low to high. The transducer comprises a gallium nitride or silicon carbide based discrete semiconductor device.

The inventors recognized that a transducer having a gallium nitride or silicon carbide based discrete semiconductor device provides high electric power with higher voltage in a downhole tool situated in a borehole.

Additional advantages and novel features are set forth in the description which follows or may be learned by those skilled in the art through reading the materials herein or practicing the invention.

BRIEF DESCRIPTION OF THE DRAWINGS

The accompanying drawings illustrate preferred embodiments of the present invention and are a part of the specification. Together with the following description, the drawings demonstrate and explain principles of the present invention.

Figure 1:
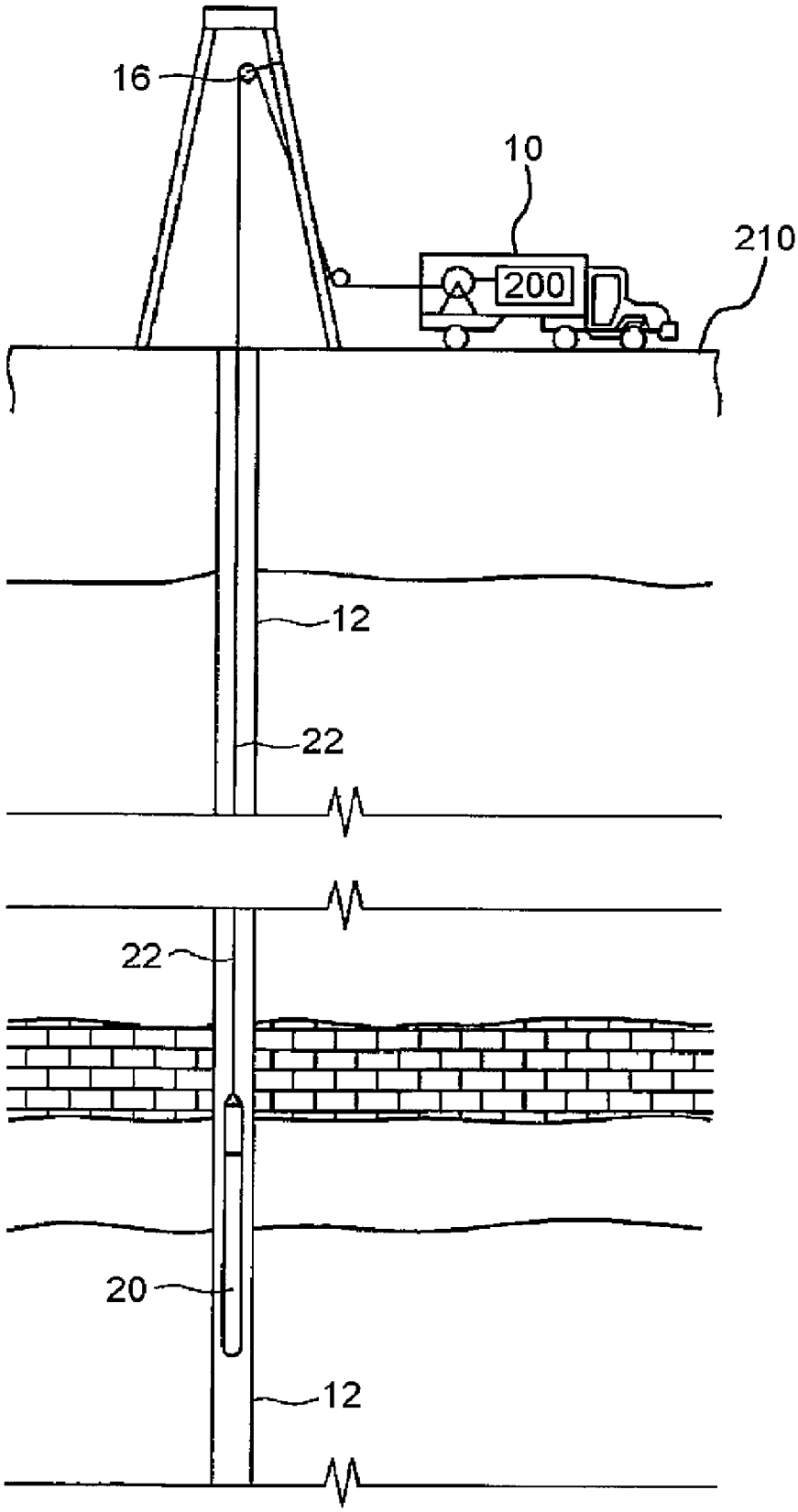
FIG. 1 is one exemplary system for downhole analysis and sampling of formation fluids utilizing a downhole tool according to one embodiment disclosed herein.

Throughout the drawings, identical reference numbers indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DESCRIPTION

Illustrative embodiments and aspects of the invention are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

The present invention is applicable to oilfield exploration and development in areas such as downhole fluid analysis using one or more fluid analysis modules in Schlumberger's Modular Formation Dynamics Tester (MDT), for example. The downhole tool of the present invention has applicability in extreme conditions such as oilfield environments. Such downhole tools may be used for collecting and storing downhole data in high temperature conditions.

The downhole tool disclosed herein enables high electric power delivery at a high environmental temperature of about 200 degrees Celsius (° C.) or above. In this, the downhole tool utilizes a wide band gap semiconductor device for realizing the high electric power delivery thereto at the high environmental temperature.

FIG. 1 is an exemplary embodiment of a system for downhole analysis and sampling of formation fluids utilizing a downhole tool according to the present disclosure. FIG. 1 depicts one possible setting for utilization of the present invention and other operating environments also are contemplated by the present disclosure.

A service vehicle 10 is situated at the formation surface 210 of a wellsite having a borehole or wellbore 12 with a downhole tool 20 suspended in the borehole 12. The downhole tool 20 typically is suspended from the lower end of a cable 22 spooled on a winch or cable drum 16 at the formation surface 210. The downhole tool 20 needs to have tolerance against high temperature as the borehole 12 has high environmental temperature conditions such as 200 degrees Celsius (° C.) or above.

Typically, the borehole 12 contains a combination of fluids such as water, mud filtrate, formation fluids, and the like. The downhole tool 20 may be used for testing earth formations and analyzing the composition of fluids from a formation. The downhole tool 20 may be used to measure various parameters such as, for example, flow rates, temperatures, pressures, fluid properties, gamma radiation properties, and the like. Additionally, the downhole tool 20 may have functions to monitor fluid injection, formation fracturing, seismic mapping, and the like.

The downhole tool 20 may be a wireline tool, a wireline logging tool, a downhole tool string, or other known means of deployment such as a drill collar, a sonde, a drill bit, a measurement-while-drilling tool, a logging-while-drilling tool, a permanent monitoring tool, and the like.

Electronics devices disclosed herein include micro electromechanical systems (MEMS). The invention contemplates that the downhole tool 20 using high temperature electronics may be used for purposes of sensing, storing, and transmitting data relating to environmental and tool parameters. In this, electronic devices disclosed may effectively sense and store characteristics relating to components of downhole tool 20 as well as formation parameters at elevated temperatures and pressures.

Typical periods of operation for wireline tools are between 5 to 50 hours; for LWD tools between 1 day to 3 weeks; and for permanent monitoring tools from 1 year to 10 years or more. Thus, electronic devices included in the downhole tool 20 should be capable of lengthening typical operational periods without servicing, increasing reliability and robustness of the downhole tool 20, and providing power demand benefits over prior equipment.

The cable 22 may be a multiconductor logging cable, wireline, or other means of conveyance that are known to persons skilled in the art.

The service vehicle 10 includes a surface electrical control system 200. The surface electrical control system 200 may have appropriate electronics and processing systems for the downhole tool 20. The cable 22 typically is electrically coupled to the surface electrical control system 200.

Figure 2:
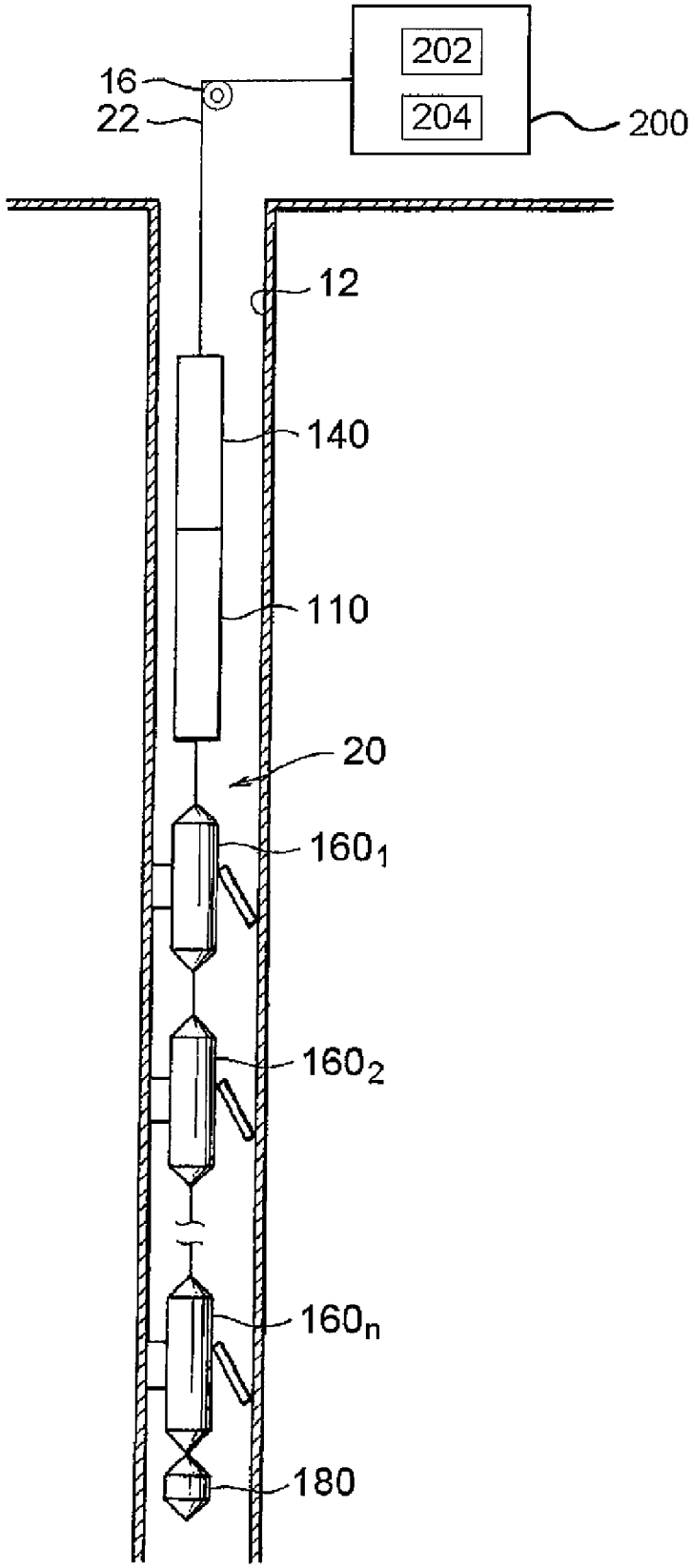
FIG. 2 is a schematic representation of one possible embodiment of a downhole tool according to the disclosure herein.

FIG. 2 shows one embodiment of the surface electrical control system 200 and the downhole tool 20.

In this embodiment, the surface electrical control system 200 includes a data communication unit 202 and an electric power generator 204.

The data communication unit 202 may include a control processor that outputs a control signal, and is operatively connected with the downhole tool 20, via the cable 22, to have the control signal delivered to the downhole tool 20.

Methods described herein may be embodied in a computer program that runs in the processor. The computer program may be stored on a computer usable storage medium associated with the processor, or may be stored on an external computer usable storage medium and electronically coupled to the processor for use as needed. The storage medium may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein. In operation, the program is coupled to operative elements of the downhole tool 20 via the cable 22 in order to receive data and to transmit control signals.

The electric power generator 204 may generate an electronic power such as a DC or AC electric power. The electric power is delivered to the downhole tool 20 via the cable 22. In this embodiment, the electric power generator 204 generates a relatively high voltage which is not less than 1000 V when supplied to the downhole tool 20 in the borehole 12.

The maximum electric power that can be delivered to the downhole tool 20 in the borehole 12 is given by the following formula, where $V_{surface}$ is the voltage of the electric power at the electric power generator 204, and $V_{head}$ is the head voltage of the downhole tool 20.

$$V_{head}=V_{surface}/2 \tag{1}$$

The electric power $P_{head}$ delivered to the downhole tool 20 is given by the following formula, where $R_{cable}$ is resistance of the cable 22.

$$P_{head}=((V_{surface})^2)/R_{cable} \tag{2}$$

Thus, the electric power $P_{head}$ is given by the following formula.

$$P_{head}=(4(V_{head})^2)/R_{cable} \tag{3}$$

From Equation (3), higher electric power can be obtained at the borehole 12 by using a higher head voltage. Thus, it is important to structure the downhole tool 20 to be capable of receiving the high voltage even at a high environmental temperature.

In this example, the downhole tool 20 includes a telemetry cartridge 140, the electronic cartridge 110, an array of tool shuttles $\mathbf{160}_1$, $\mathbf{160}_2$, . . . , $\mathbf{160}_n$, and an array terminator 180 provided in this order from top to down in the borehole 12. The telemetry cartridge 140 communicates with the surface electrical control system 200. U.S. Pat. No. 6,630,890 discloses such a structure; the contents of which are incorporated herein by reference in their entirety.

In this embodiment, the downhole tool 20 includes a downhole data acquisition system placed in the electronic cartridge 110 and the array of tool shuttles $\mathbf{160}_1$, $\mathbf{160}_2$, . . . , $\mathbf{160}_n$.

As mentioned above, the relatively high voltage not less than 1000 V is supplied to the downhole tool 20 in the borehole 12. Therefore, the downhole tool 20 includes a power transducer, which is included in the electronic cartridge 110, to transduce the voltage of the input signal from high to low such that the relatively low voltage is applied to the elements, such as sensors (included in the array of tool shuttles $160_1$, $160_2$, . . . , $160_n$), positioned downstream of the transducer in the downhole tool 20, via a downhole tool power line. The transducer of the downhole tool 20 is electrically connected to the electric power generator 204 via the cable 22 to be supplied with the electric power generated by the electric power generator 204.

Figure 3:
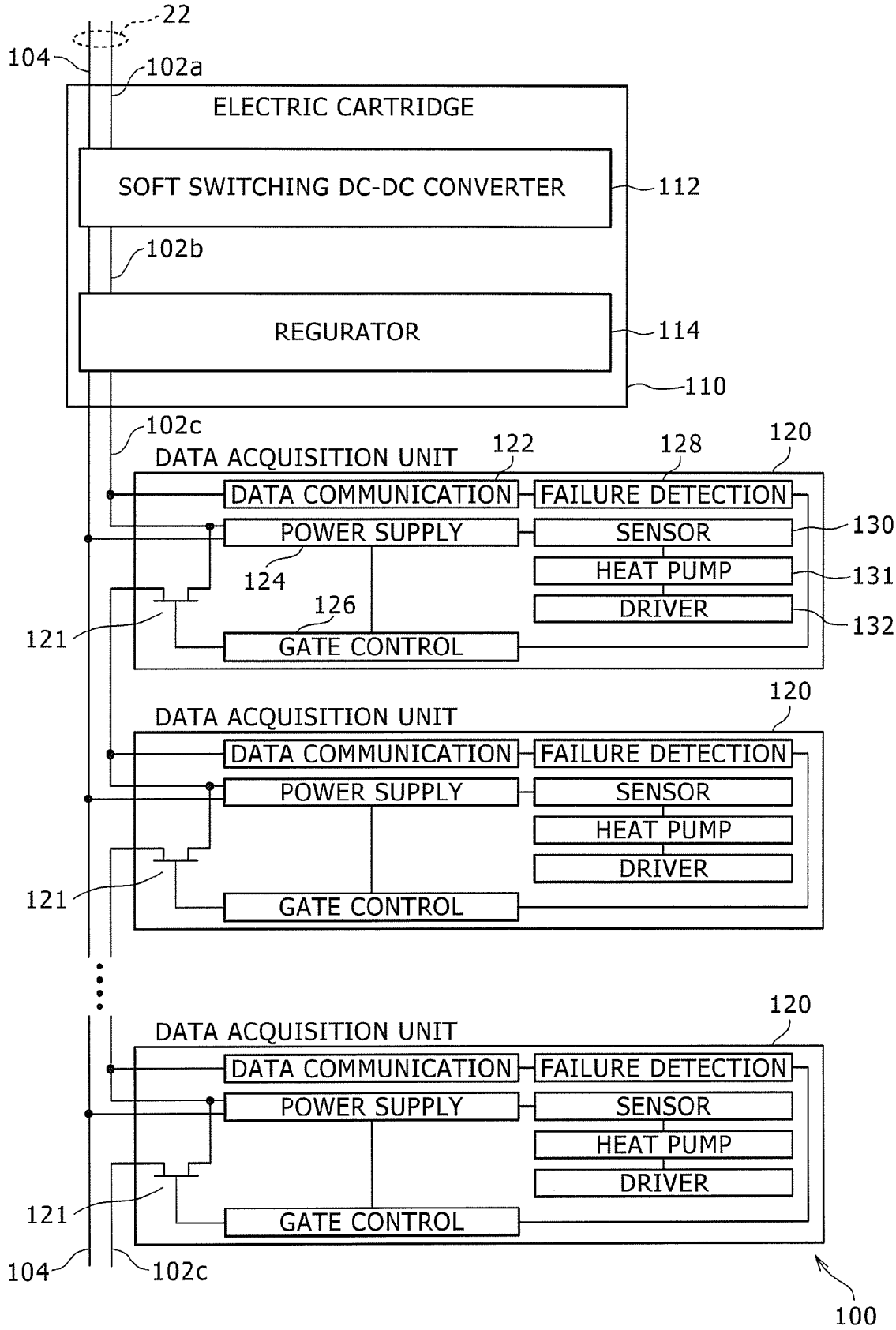
FIG. 3 shows a block diagram of a downhole data acquisition system according to one embodiment herein.

FIG. 3 shows a block diagram of one downhole data acquisition system 100 according to the present embodiment. In this case, the electric power generator 204 generates a DC power and provides it to the downhole data acquisition system 100 via the cable 22. The downhole data acquisition system 100 includes the electric cartridge 110 and a plurality of data acquisition units 120. Each of the data acquisition units 120 is included in each of the tool shuttles $160_1$, $160_2$, . . . , and $160_n$ shown in FIG. 2, respectively.

The electric cartridge 110 includes a converter composed of gallium nitride or silicon carbide based discrete semiconductor devices (hereinafter referred to as GaN/SiC based discrete semiconductor devices) to create a DC (direct current) voltage for the data acquisition units 120. The converter may be a multi-output switching converter, multiple converters, or their combination. The multi-output switching converter, multiple converters or their combination create necessary power supply voltages in the downhole data acquisition system 100. The voltages typically needed in the system 100 are 5 V and/or 3.3 V for digital circuitry and +/−12 to +/−15 tracking supplies for analog circuitry. Solenoid drivers require 12 to 24 V DC. Thus, the transducer of the embodiment may be capable of transducing the high voltage not less than 1000 V supplied by the electric power generator 204 to such low voltage as is necessary for the digital circuitry, the analog circuitry, or the solenoid.

Here, "discrete semiconductor device" means an electronic component with just one circuit element, either passive (resistor, capacitor, inductor, diode) or active (transistor or vacuum tube), other than an integrated circuit. The term is used to distinguish the component from integrated circuits. In detail, "a GaN/SiC based discrete semiconductor device" means a device including a GaN/SiC layer and one or more device having a single function formed on the layer.

With this structure, even when heat is generated by a large amount of current flowing through one of the discrete semiconductor devices, the generated heat does not influence other devices. Although for downsizing, integrated circuits in which a plurality of functional elements are formed on the semiconductor layer are known and used, the present inventors recognized benefits that are available with discrete components for the downhole tool 20. The inventors have found that a relatively larger size of discrete components is offset by other benefits such as the above heat influence when the discrete components are used in the downhole tool 20. Further, fabrication yield, design flexibility, high power applications, high temperature reliability, customization, are some of the benefits that are obtainable when using the discrete semiconductor device in high temperature downhole applications.

The discrete semiconductor device may be a diode, a transistor, and the like, including but not limited to, a MESFET (metal semiconductor field effect transistor), a HEMT (high electron mobility transistor), a HFET (hetero-junction field effect transistor), a bipolar junction transistor, a MOSFET (metal oxide semiconductor field effect transistor), a FESBD (field effect schottky barrier diode), and a photodiode, and a LED (light emitting diode). The discrete semiconductor device may further include a sapphire substrate, a silicon substrate, a silicon carbide substrate, a silicon on sapphire substrate, or any other substrate on which the GaN/SiC layer is formed.

In this example, the electric cartridge 110 includes a soft switching DC-DC converter 112 and a regulator 114. The electric cartridge 110 is placed at the upper part of the downhole tool 20 to which the cable 22 is connected. In this example, the soft switching DC-DC converter 112 functions as the transducer. The soft switching DC-DC converter 112 may be composed of a GaN/SiC based discrete semiconductor device.

Each of the data acquisition units 120 includes a data communication unit 122, a power supply unit 124, a gate control unit 126, a failure detection unit 128, and a sensor 130. In this example, each of the data acquisition units 120 functions as a sensing device.

In FIG. 3, the supply of electronic power is schematically depicted by lines 102*a*, 102*b*, and 102*c*, and the return way of the signal is schematically depicted by line 104.

The soft switching DC-DC converter 112 is a switching converter circuit that converts an input high voltage 102*a* to a first low voltage 102*b*, which is easier to handle. The output voltage of the soft switching DC-DC converter 112 may be any value below the input high voltage. For example, the output voltage of the soft switching DC-DC converter 112 may be 5 V and/or 3.3 V.

Figure 4:
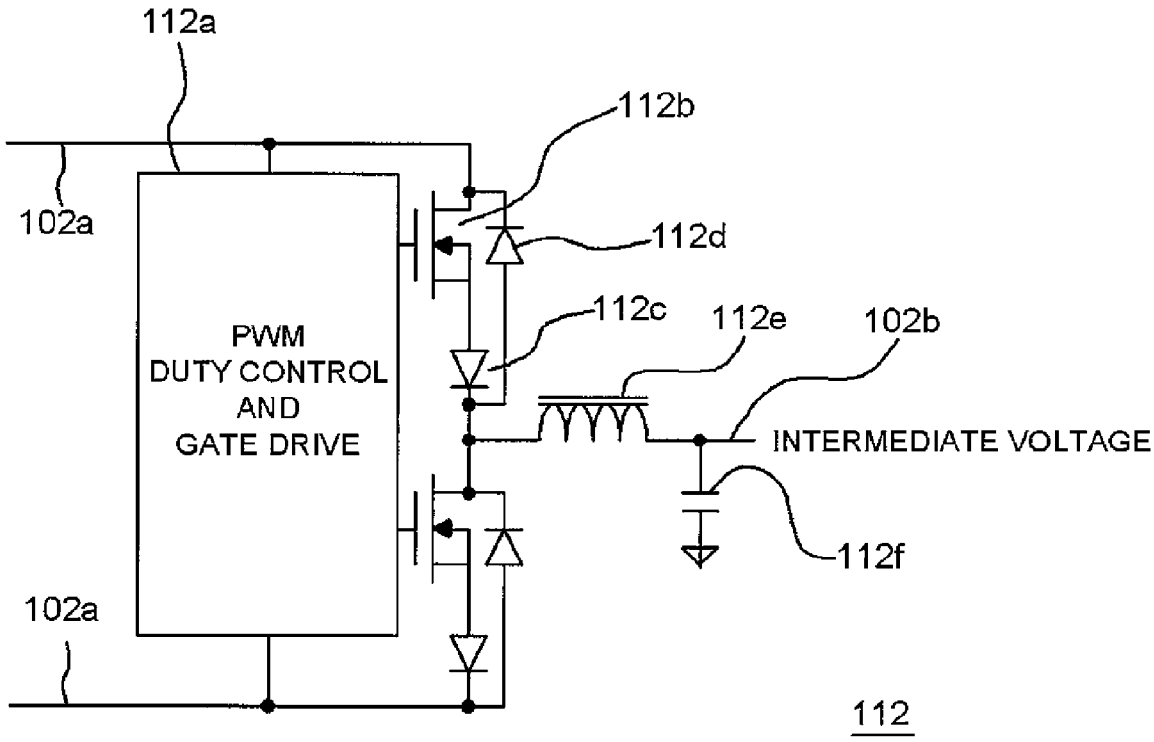
FIG. 4 is a schematic depiction of one example of a soft switching DC-DC converter as disclosed herein.

FIG. 4 shows an example of the soft switching DC-DC converter 112. The soft switching DC-DC converter 112 includes a PWM duty control and gate drive unit 112*a*, FETs 112*b*, diodes 112*c* each connected to the source of each of the FETs 112*b*, diodes 112*d* each connected in parallel to each of the FETs 112*b* and the diodes 112*c*, a choke coil 112*e*, and a capacitor 112*f*. The diodes 112*d* are so-called fly-wheel diodes. The fly-wheel diode allows electric current flows along the diode in a forward direction.

Each of the FETs 112*b*, each of the diodes 112*c*, and each of the diodes 112*d* may be composed of a GaN/SiC based discrete semiconductor device. For example, each of the FETs 112*b* may be a SiC based discrete FET, and each of the diodes 112*c* and 112*d* may be a discrete SiC diode.

So far, semiconductors made with silicon technology have been used for the switching devices such as the components included in the electric cartridge 110. Therefore, the voltage of the electric power to be supplied to the switching devices is limited by the features of the diodes, FETs, and/or the IGBTs (insulated gate bipolar transistors) made with conventional silicon technology at the high temperature environment of about 200 degrees Celsius (° C.) or above.

By constituting each of the FETs 112*b*, each of the diodes 112*c*, and each of the diodes 112*d* with a GaN/SiC based discrete semiconductor device, higher switching speed, lower conduction loss, and lower leak current of the soft switching DC-DC converter 112 can be obtained compared with the converters made of silicon technology. Further, high electric power with higher voltage can be delivered to the downhole tool 20.

The wide band gap semiconductors such as III-V semiconductors and SiC semiconductors with a high dielectric breakdown field, good electron transport properties and favorable thermal conductivity are suitable for high power/temperature devices. As for the III-V semiconductor, the heterostructure of AlGaN/GaN has high electron mobility and high carrier density of two dimensional electron gas (2DEG) due to large piezo-electric field effect. Hetero-junction field effect transistors (HFET) using the AlGaN/GaN heterostructure provide superior characteristics compared with Si FETs (O. Akutus, Z. F. Fan, S. N. Mohammad, A. E. Botchkarev, and H.

Morkoc, "High temperature characteristics of AlGaN/GaN modulation doped field effect transistors", Applied PhySiCs Letters, vol. 69, pp. 3872-3874, 1996, T. P. Chow and R. Tyagi, "Wide bandgap compound semiconductors for superior high-voltage unipolar power devices", *IEEE Trans. Electron Device*, vol. 41, pp. 1481-1483, 1994, and A. Ozgur, W. Kim, Z. Fan, A. Botchkarev, A. Salvador, S. N. Mohammad, and B. Sverdlov, "High transconductance normally-off GaN MODFETs", *Electronics Letters*, vol. 31, pp. 1389-1390, 1995).

Further, with this feature, the soft switching DC-DC converter 112 is capable of working at higher temperature than conventional devices using silicon technology, thus the size of the heat sink can be reduced.

As for the soft switching DC-DC converter 112, a converter which is capable of soft switching such as a buck converter may be used. In this case, by choosing inductances and capacitances properly, a switch composed of SiC diodes and FETs is turned on and off in a soft switch manner that reduces switching loss over non-soft switching topology converter. The soft switching is possible with other topology such as a phase shift converter. Higher switching speed allows higher switching frequency which reduces size of the inductor and capacitor. Linear converter can also be used in the stage if low noise is required.

Referring back to FIG. 3, the first low voltage (or intermediate voltage) 102*b* output from the soft switching DC-DC converter 112 is input to the regulator 114. The regulator 114 may also function as a part of the transducer in this embodiment. The regulator 114 transduces the first low voltage 102*b* to a second lower voltage 102*c*. In this example, the components such as diodes and transistors of the regulator 114 may also be composed of a GaN/SiC based discrete semiconductor device. The first low voltage can be useful for other building blocks not shown in the drawings and thus the first low voltage may be transmitted to the other building blocks directly (not shown in the drawings). Also the high voltage 102*a* is useful for other high power loads such as a motor drive, an acoustic, an electric or a magnetic transmitter and thus the high voltage may be transmitted to the other high power loads (not shown in the drawings).

Each of the data acquisition units 120 includes a switch (shown as a transistor 121) to feed the electric power for the units connected therebelow. When the downhole data acquisition system 100 detects a failure in a certain unit 120, the upper unit 120 opens the switch to disconnect the units 120 therebelow. Hence the units 120 above the failed unit 120 can be isolated so that the system can be operated. For this application, normally on device is more suitable than normally off device. Normally off is important for fail-safe circuitry of power supply. The fail-safe circuitry guarantees no short circuitry failure when control circuitry or power device fails. It is preferable to use SiC based Metal Oxide Semiconductor (MOS) device for a normally off device and GaN based HFET device for a normally on device. Thus, in this application, GaN based discrete HFETs may be selected for the transistors 121 and SiC based discrete semiconductor devices for the components other than the transistors 121 in this application.

Figure 5:
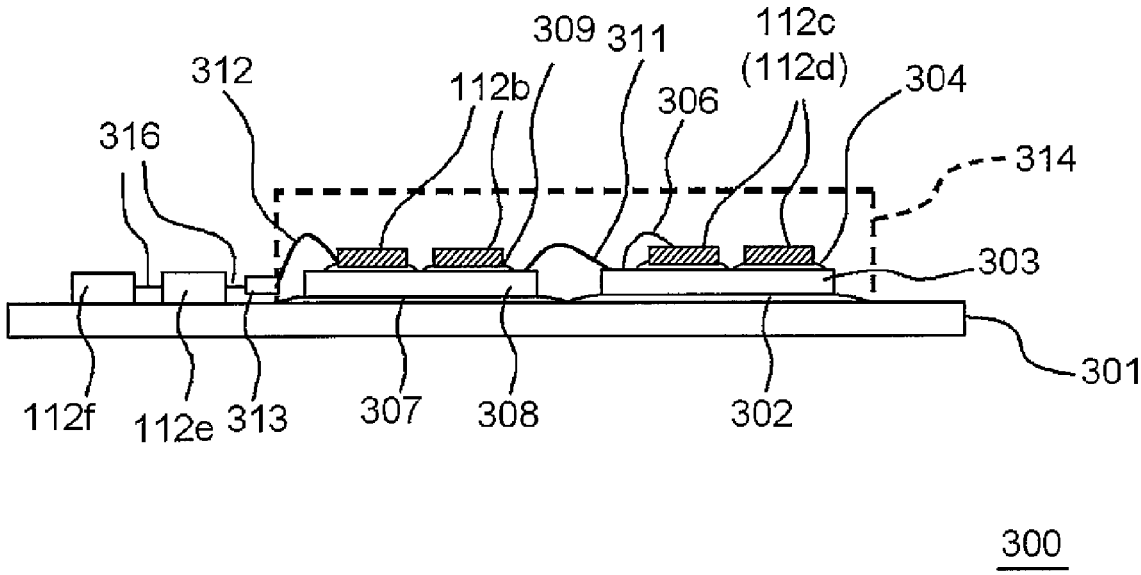
FIG. 5 is a cross sectional view of a packaged half bridge module, which may be used for a soft switching DC-DC converter.

FIG. 5 is a cross sectional view of a packaged structure in which the FETs 112*b*, the diodes 112*c*, and the diodes 112*d* are packaged in an enclosure.

The illustrative packaged structure 300 includes the FETs 112*b* and the diodes 112*c* (and the diodes 112*d*). The diodes 112*c* (and the diodes 112*d*) are placed on a substrate 303 and attached thereto with a solder 304. The FETs 112*b* are placed on a substrate 308, which is separated from the substrate 303, and attached thereto with a solder 309. The substrates 303 and 308 are placed on a base 301 and attached thereto with adhesives 302 and 307, respectively. The diodes 112*c* (and the diodes 112*d*) and FETs 112*b* are electrically connected through wires 306 and 311. The wires 306 and 311 may be Au wires. Thus structured FETs 112*b* and the diodes 112*c* (and the diodes 112*d*) may be packaged with enclosure 314. The choke coil 112*e* and the capacitor 112*f* are placed outside of the enclosure 314 on the substrate 301. The choke coil 112*e* and the FETs 112*b* and/or the diodes 112*c* (and the diodes 112*d*) are electrically connected via a lead pin 313 that passes through the side of the enclosure 314. The lead pin 313 is electrically connected to the FETs 112*b* and/or the diodes 112*c* (and the diodes 112*d*) through a wire 312. The wire 312 may be an Al wire. The choke coil 112*e* and the capacitor 112*f* are also connected with the lead pin 313 through a wire or pattern on the substrate 301.

In this example, materials for the solders 304 and 309 may be selected to have tolerance against high environmental temperature such as those having high melting point. Materials for the base 301 and the substrates 303 and 308 may be selected to have good thermal dissipation and matching of the thermal coefficient with each other.

For example, the substrate 308 may be made of AlN. The substrate 303 may be made of $Al_2O_3$. The base 301 may be made of CuW which has good thermal dissipation and matching of the thermal coefficient with the substrate 308.

The adhesive 307 may be an Au-Sn eutectic solder which has a melting point of 278 degrees C. The solder 304 may also be an Au-Sn eutectic solder which has a melting point of 278 degrees C. The adhesive 302 may be an epoxy adhesive. The solder 309 may be an Au-Si solder which has a melting point of 363 degrees C. In operation of the packaged structure 300, as large currents do not flow in the diodes 112*c* (and the diodes 112*d*), the self heating would be negligible on the substrate 303. On the other hand, as large currents flow in the FETs 112*b*, the self heating effect would be significant. For example, provided that the total power dissipation is 50 W, the temperature increase due to the self heating of the FETs 112*b* is calculated to be 68 K. Thus, it is better for the solder 309 to have a higher melting point. By using such adhesives and solders, the components are reliably and firmly attached to the base 301 or to the substrates 308 and 303, therefore the packaged structure 300 can be operative under high temperature conditions such as oilfield environments.

Figure 6:
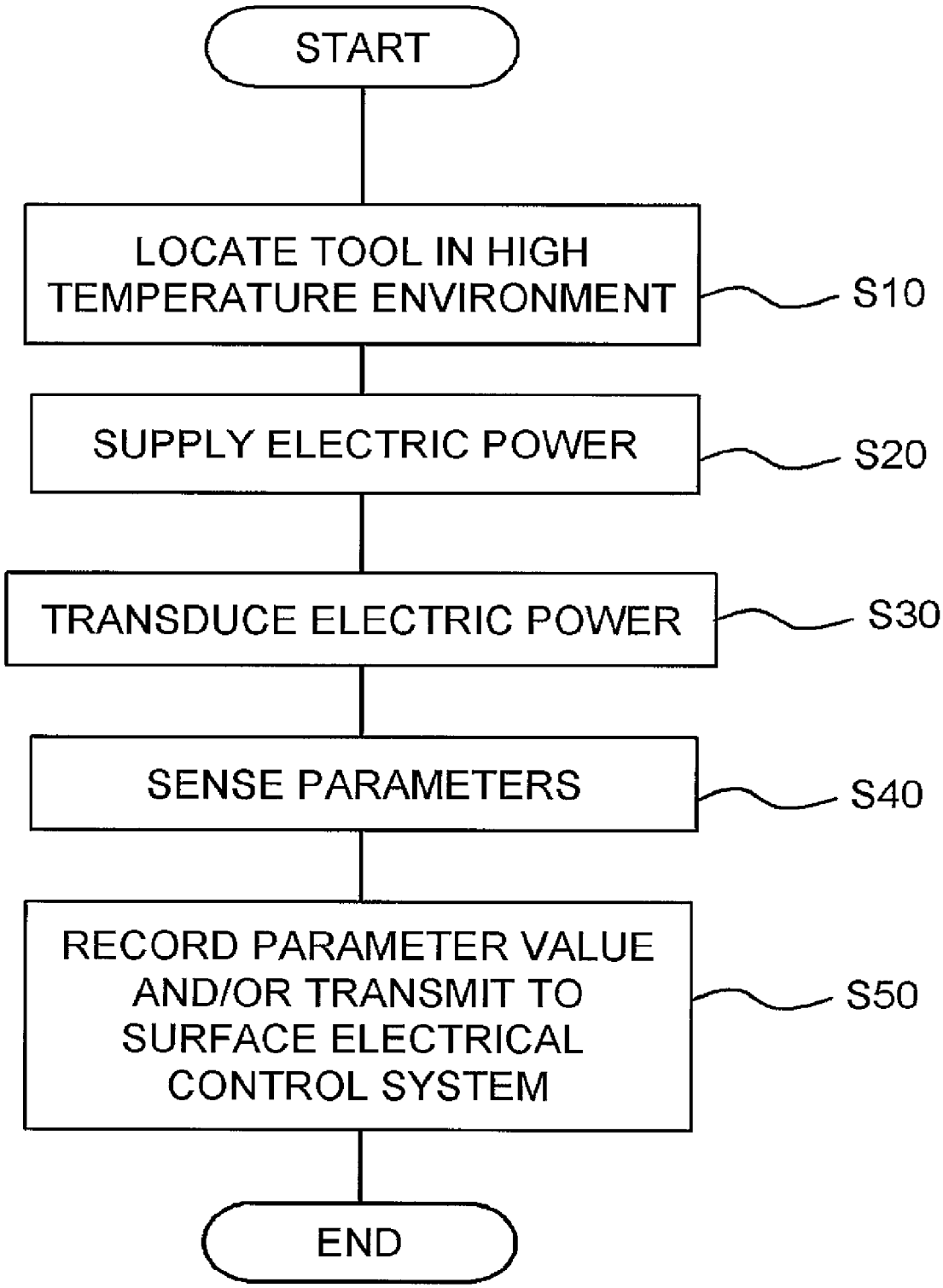
FIG. 6 is a flowchart showing a method for detecting conditions in a borehole using a downhole tool according to the disclosure herein.

FIG. 6 is a flowchart showing a method for detecting local conditions in a borehole 12 using the downhole tool 20.

Firstly, the downhole tool 20 is located in a high temperature environment of about 200 degrees Celsius (° C.) or above, for example (S10). Then, the electronic power having a relatively high voltage is supplied to the downhole tool 20 from the electric power generator 204 via the cable 22 (S20). Then, the transducer transduces the relatively high voltage to the low voltage and supplies the low voltage to the sensors (S30). The sensors of the downhole tool 20 sense the parameters (S40). The parameters may be data relating to one or more of pressure, temperature, fluid flow, acceleration, rotation, or vibration or any other downhole tool performance parameter. Furthermore, the downhole tool 20 may be used to acquire data relating to density, viscosity, porosity, resistivity, or any other environmental parameter of the surrounding fluids and/or formations. The sensed parameters are recorded and/or transmitted to the surface electrical control system 200.

Figure 7:
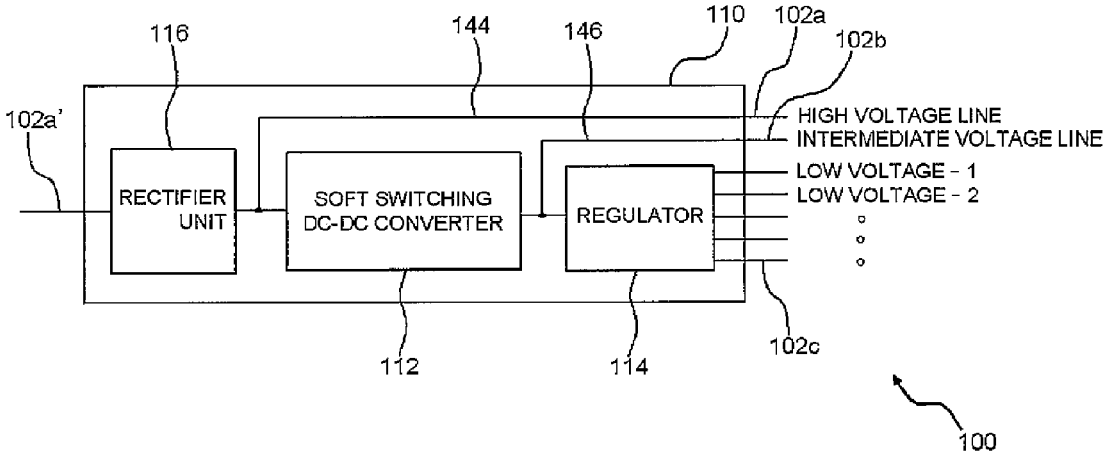
FIG. 7 is a block diagram depiction of another example of an electric cartridge.

In another example, the electric power generator 204 may generate an AC power or AC and DC power and provide it to the downhole data acquisition system 100 via the cable 102*a*. In such a case, the electric cartridge 110 of the downhole data acquisition system 100 may further include a rectifier unit 116 to convert AC to DC as shown in FIG. 7. In this example, as well, the soft switching DC-DC converter 112 has a same structure as shown in FIG. 4.

Figure 8:
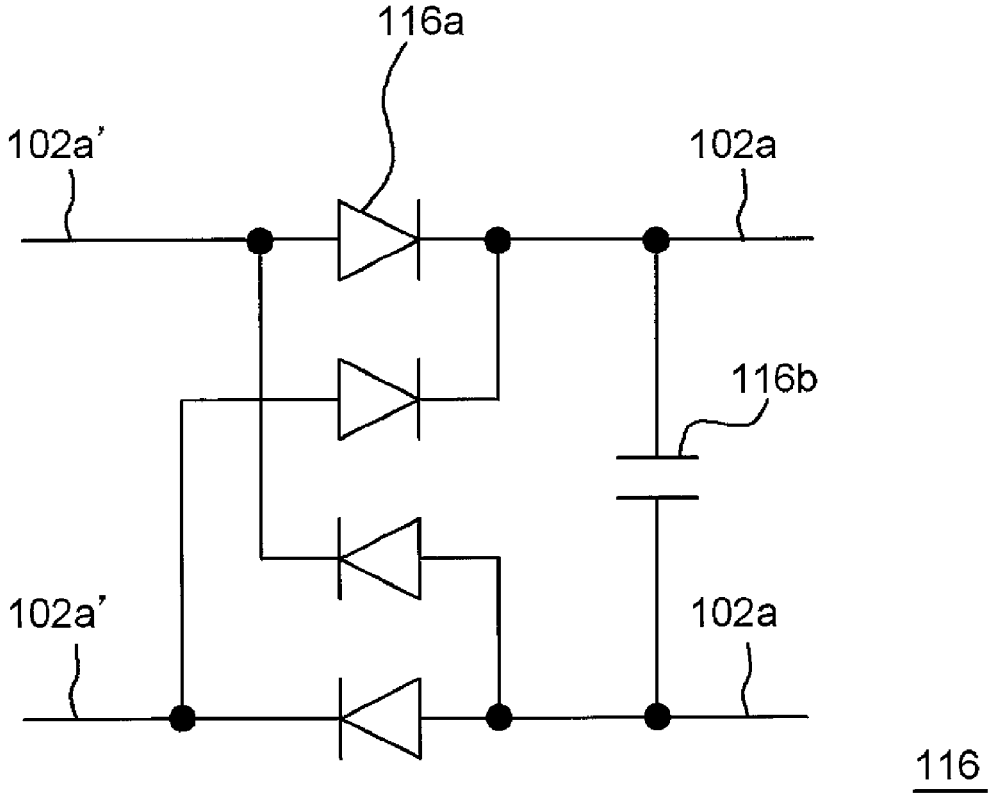
FIG. 8 shows one example of a rectifier unit of the electric cartridge in FIG. 7.

FIG. 7 is a block diagram depiction of another example of an electric cartridge. FIG. 8 shows an example of the structure of the rectifier unit 116. The rectifier unit 116 includes diodes 116*a* and a capacitor 116*b*. Each of the diodes 116*a* may be composed of a GaN/SiC based discrete semiconductor device. For example, each of the diodes 116*a* may be a discrete SiC schottky diode.

Other possible downhole applications will now be discussed. The downhole data acquisition system 100 may include a high voltage generator that functions as a transducer and transduces the voltage of an input signal from low to relatively high of not less than 1000 V in the borehole 12. In this case, the components of the high voltage generator such as diodes and transistors may be composed of GaN/SiC based discrete semiconductor devices. The high voltage generator may be used for a photo multiplier, or an X-ray generator. When the high voltage generator is used for a photo multiplier, the low voltage may be for example 15 V and the transduced high voltage may be several kV, for example. When the high voltage generator is used for an X-ray generator, the low voltage may be for example 50 V and the transduced high voltage may be 10th kV, for example. The high voltage generator may be an ultra high voltage generator capable of producing a high voltage for example up to 10th kV, for example 83 kV.

Figure 9:
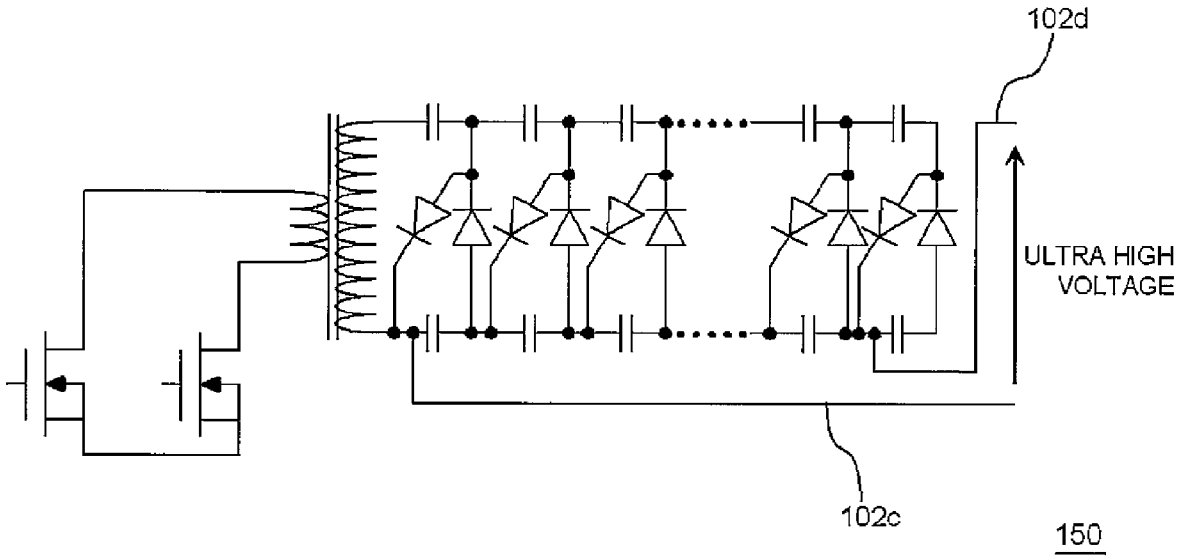
FIG. 9 shows one example of an ultra high voltage generator.

FIG. 9 shows an example of the ultra high voltage generator 150 for a photo multiplier. Each of the diodes and transistors are composed of a GaN/SiC based discrete semiconductor device. The ultra high voltage generator 150 transduces the input low voltage (second lower voltage 102*c*) to a higher voltage 102*d*.

The ultra high voltage generator 150 includes a ladder network with diodes and capacitors in which the diodes are composed of a GaN/SiC based discrete semiconductor device. For example, each of the diodes may be a discrete SiC diode. As the SiC diode shows a low leak performance, ultra high voltage generator 150 using the SiC diodes can be stably used at a high temperature of about 200 degrees Celsius (° C.) or above.

Further, other devices included in the downhole data acquisition system 100 may be composed of a GaN/SiC based discrete semiconductor device.

When the downhole data acquisition system 100 includes a DC-AC inverter that converts DC to AC, each of the components of the DC-AC inverter such as diodes and transistors may be composed of a GaN/SiC based discrete semiconductor device.

When the downhole data acquisition system 100 includes a motor driver, in which a load is an electric motor, each of the components of the motor driver such as diodes and transistors may be composed of a GaN/SiC based discrete semiconductor device.

When the downhole data acquisition system 100 includes a transmitter driver, for example a piezoelectric transmitter, each of the components of the transmitter driver such as diodes and transistors may be composed of a GaN/SiC based discrete semiconductor device. As the piezoelectric transmitter requires high voltage such as 3000 V to be driven. By using the diodes and transistors composed of the GaN/SiC based discrete semiconductor devices, the high voltage generated by the electric power generator 204 can be directly used.

The downhole tool 20 may further include a stirling cooler (a heat pump) to cool whole or a part of the downhole tool 20. In one embodiment of the present invention, when the downhole data acquisition system 100 includes a driver 132 for a stirling cooler or a heat pump 131, for example a piezoelectric transmitter, each of the components of the transmitter driver such as diodes and transistors may be composed of a GaN/SiC based discrete semiconductor device. Since the driver of the stirling cooler or the heat pump cannot be cooled by the cooler, this driver circuit has to work at the high environmental temperature of about 200 degrees Celsius (° C.) or above. By composing the components of the driver circuit with a GaN/SiC based discrete semiconductor device, the driver can work even at the high environmental temperature.

Since the gate leak current is much smaller with GaN/SiC FET over conventional Si FET, the gate driver circuit can be simplified. For example with Si FET, gate leak reaches 100μA while SiC FET leakage remains around 1μA. In order to drive the gate to 15 VDC, the power required for the two devices are 1.5 mW and 15μW, respectively. 15μW is low enough to use simple driver such as photo coupler without additional driver, which simplifies the driver circuit very much.

The above GaN technology may be used for various semiconductor elements. GaN based components can be provided on electrically insulated wafers. In this case, the circuit has an active region isolated from the wafer bulk for greatly reducing in size of a depletion region, so that leakage currents are reduced accordingly. The insulated wafer typically includes an insulating layer between the circuitry and the wafer substrate bulk and is suitable for high temperature and/or downhole applications.

One insulating layer includes sapphire. It is possible to construct electronics that perform well at elevated temperatures by patterning suitably-designed devices using a sapphire substrate with a thin surface GaN layer. Generally, GaN has a large lattice mismatch with sapphire as well as SiC. However, unlike SiC, GaN has a small thermal mismatch with sapphire. Such small thermal mismatch allows use of the components at elevated temperature environments (for example, in the borehole). The GaN surface layer can maintain certain qualities and properties without generating lattice defect, such as a dislocation at elevated temperatures. Accordingly, the device may continue to perform adequately without degradation or failure in high-temperature environments (for example, in the borehole). The same thermal mismatch is achieved by a substrate of silicon, silicon-on-sapphire or 6H-SiC, in addition to the sapphire substrate. In particular, since 6H-SiC has a high thermal conductivity, 6H-SiC can provide a suitable high power device in combination with GaN. Alternatively, using a thin Si substrate, a high power device can be achieved as well. The lattice mismatch can be reduced by providing a buffer layer between the GaN layer and the sapphire substrate or layer. The buffer layer, for example, may consists of a single layer of GaN or AlN, or a bi-layer, or alternating multilayers of GaN and AlN.

Figure 10:
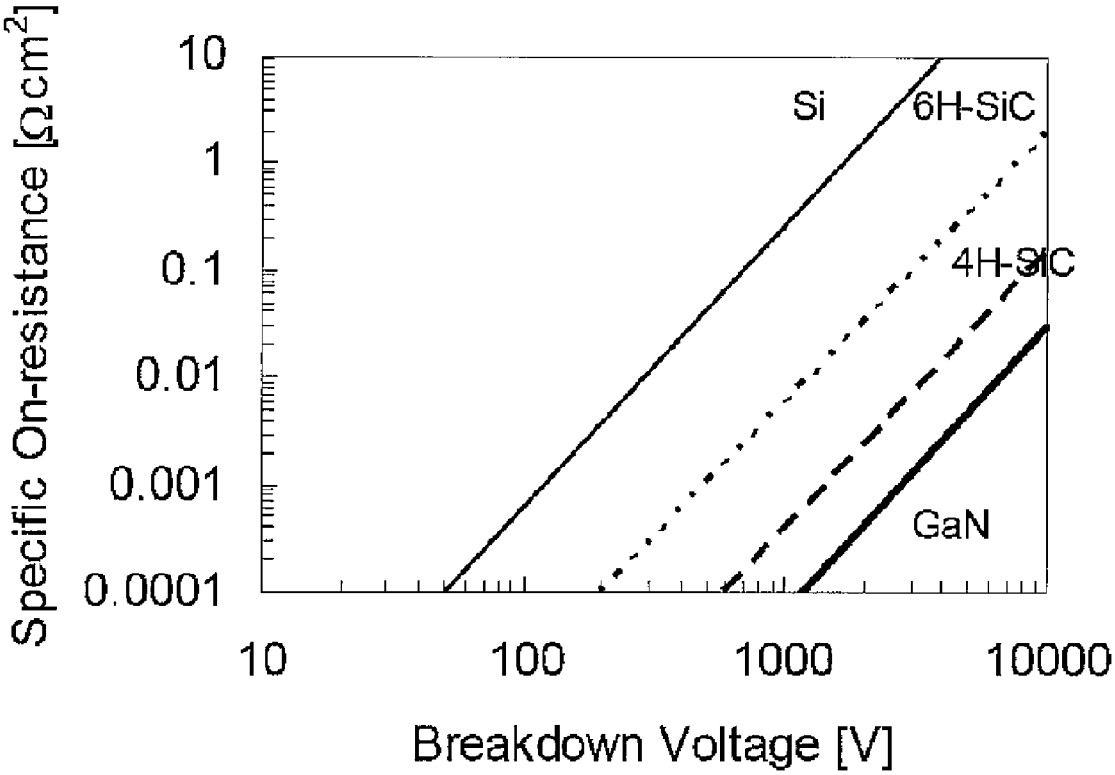
FIG. 10 shows the calculated specific on-resistance against the breakdown voltage of Si, SiC, and GaN.

Specific on-resistance of the AlGaN/GaN HFET (heterojunction field effect transistor) is expected to be lower than that of Si or GaAs. FIG. 10 shows the calculated specific on-resistance against the breakdown voltage of Si, SiC, and GaN. The specific on-resistance of SiC and GaN was calculated to be less than Si due to its large band gap and a high breakdown field. Especially, the on state resistance of GaN was less than 1/1000 compared with that of Si. The switching speed of the AlGaN/GaN HFET is expected to be faster than a conventional Si MOSFET. It is, therefore, expected that high efficiency circuit applications can be realized using the AlGaN/GaN HFET (S. Yoshida, J. Li, T. Wada, and H. Takehara, "High-Power AlGaN/GaN HFET with a Lower On-state Resistance and a Higher Switching Time for an Inverter Circuit", in Proc. 15th ISPSD, pp. 58-61, 2003). Also, the AlGaN/GaN HFET can operate in high temperature ranges where a conventional Si MOSFET cannot be operated. The high temperature and low loss operation of the HFET enables elimination of cooling systems and make it suitable for high temperature downhole power electronics.

The preceding description has been presented only to illustrate and describe certain embodiments and aspects. It is not intended to be exhaustive or to limit the invention to any precise form disclosed. Many modifications and variations are possible in light of the above teaching.

The embodiments and aspects were chosen and described in order to best explain the principles of the invention and its practical applications. The preceding description is intended to enable others skilled in the art to best utilize the principles described herein in various embodiments and with various modifications as are suited to the particular use contemplated. It is intended that the scope of the invention be defined by the following claims.

What is claimed is:

1. A downhole tool, comprising:

a downhole data acquisition system configured to be electrically connected to an electric power generator at a formation surface to be supplied with the electric power generated by the electric power generator, the downhole data acquisition system including a sensing device configured for detecting a condition in the borehole, and a transducer configured for transducing the voltage of an input signal from high to low or low to high, the transducer comprising a gallium nitride or silicon carbide based discrete semiconductor device, wherein the downhole data acquisition system comprises:

a heat pump to cool at least a part of the downhole data acquisition system;

a driver for the heat pump, the driver comprising a second gallium nitride or silicon carbide based discrete semiconductor device.

2. The downhole tool according to claim 1, wherein the electric power generated by the electric power generator has a high voltage not less than 1000 V when supplied to the downhole data acquisition system in the borehole and the transducer receives the voltage generated by the electric power generator and outputs a low voltage to the sensing device.

3. The downhole tool according to claim 2, wherein the electric power generator generates a direct current with the high voltage and the transducer is a DC-DC converter.

4. The downhole tool according to claim 2, wherein the low voltage output by the transducer is not more than 200V.

5. The downhole tool according to claim 1, wherein the transducer is a high voltage generator transducing the voltage of the input signal from a low voltage to a high voltage of not less than 1000V in the borehole.

6. The downhole tool according to claim 5, wherein the electric power generator is configured to generate an X-ray in downhole.

7. The downhole tool according to claim 5, wherein the electric power generator is configured to supply a downhole photo multiplier with the high voltage.

8. The downhole tool according to claim 1, wherein the discrete semiconductor device has a single function of a diode or a transistor.

9. The downhole tool according to claim 1, wherein the sensing device detects a parameter selected from the group consisting of pressure, temperature, fluid flow, acceleration, rotation, vibration, density, viscosity, porosity and resistivity of the formation.

10. The downhole tool according to claim 9, wherein the formation comprises a fluid.

* * * * *